235-379 SR
7/10/84 XR 4,459,052

United States Patent [19]

Lundblad

[11] Patent Number: 4,459,052

[45] Date of Patent: Jul. 10, 1984

[54] APPARATUS FOR DISPENSING VALUABLE PAPERS AND OTHER DOCUMENTS

[76] Inventor: Leif Lundblad, 102 Haradsvagen, S-141 41 Huddinge, Sweden

[21] Appl. No.: 464,705

[22] Filed: Feb. 7, 1983

Related U.S. Application Data

[63] Continuation-in-part of Ser. No. 264,272, May 18, 1981, abandoned.

[30] Foreign Application Priority Data

May 19, 1980 [SE] Sweden ..... 8003705

[51] Int. Cl.[3] ..... B41J 3/02

[52] U.S. Cl. ..... 400/124; 271/9; 400/605; 400/629; 194/DIG. 26; 235/379

[58] Field of Search ..... 101/232, 93.05, 93.15; 400/124, 605, 629, 638; 271/4, 9, 145, 303; 270/1.1; 221/95; 194/DIG. 26; 235/379

[56] References Cited

U.S. PATENT DOCUMENTS

| | | | |
|---|---|---|---|
| 3,791,392 | 2/1974 | Hanson | 194/DIG. 26 |
| 4,017,004 | 4/1977 | Onoe et al. | 271/9 |
| 4,027,142 | 5/1977 | Paup et al. | 235/379 |
| 4,066,253 | 1/1978 | Lvndblad | 271/9 X |
| 4,252,251 | 2/1981 | Ek et al. | 271/154 X |
| 4,283,097 | 8/1981 | Lundblad | 271/145 |
| 4,337,864 | 7/1982 | McLean | 194/DIG. 26 |
| 4,343,582 | 8/1982 | Lundblad et al. | 271/303 X |
| 4,359,630 | 11/1982 | Simonotti et al. | 235/379 |
| 4,381,705 | 5/1983 | Roes | 271/303 X |
| 4,389,126 | 6/1983 | Honma et al. | 101/93.05 |

FOREIGN PATENT DOCUMENTS

| | | | |
|---|---|---|---|
| 23995 | 2/1977 | Japan | 194/DIG. 26 |
| 94461 | 7/1981 | Japan | 235/379 |

*Primary Examiner*—E. H. Eickholt
*Attorney, Agent, or Firm*—Kinzer, Plyer, Dorn & McEachran

[57] ABSTRACT

An apparatus for dispensing valuable papers and other documents, such as banknotes, checks, receipts, vouchers etc., from a plurality of cassettes (11–13) to an outfeed opening (10) includes a plurality of separate feed devices, one for each cassette, which separate feed devices are incorporated in series in a feed means from the cassette (13) located farthest away from the outfeed opening to the outfeed opening (10), common for all cassettes. For initiating the outfeed of valuable papers and other documents, there is provided an intitiating means (15) which can be actuated by a customer or a clerk. The apparatus further comprises an additional cassette served by a separate feed device (142) and a printing means (141), which further cassette (14) is intended for checks, receipts or like documents and the separate feed device (142) of which further cassette is incorporated in series in the said feed means and is arranged to advance a check, receipt or like document to a printing position adjacent the printing means (141) and, subsequent to printing said check, receipt or like document, to feed said check, receipt or like document to the outfeed opening (10). The printing means (141) is arranged upon actuation of the initiator means (15) by a customer or clerk to print on the advanced check, receipt or like document in accordance with the dispensation of valuable paper and other documents ordered by the customer or clerk.

6 Claims, 5 Drawing Figures

Fig. 4.
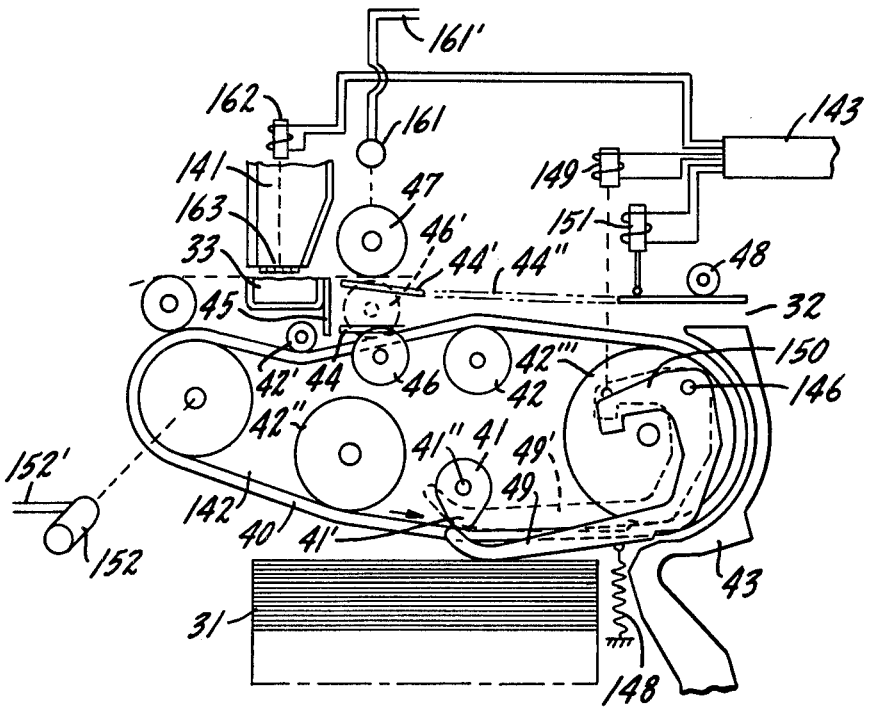
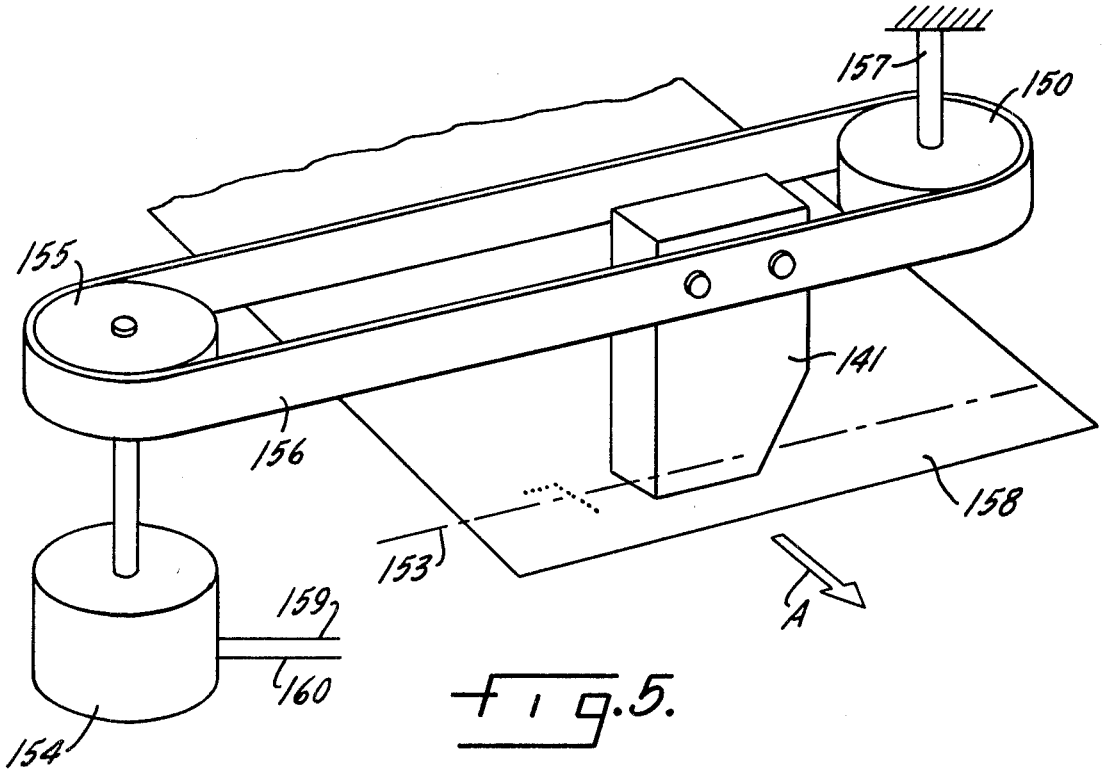
Fig. 5.

APPARATUS FOR DISPENSING VALUABLE PAPERS AND OTHER DOCUMENTS

This is a continuation-in-part application of my copending application Ser. No. 264,272, filed May 18, 1981 now abandoned.

TECHNICAL FIELD

The present invention relates to an apparatus for dispensing valuable papers and other documents, such as banknotes, checks, receipts, vouchers etc. from a plurality of cassettes to an outfeed opening. Each of the cassettes is arranged to cooperate with a respective, separate feed device, one for each cassette, incorporated in series in a feeding means from the cassette located farthest away from the outfeed opening to the outfeed opening which is common to all cassettes. For the purpose of initiating dispensement of valuable papers and other documents, there is provided an initiating means which can be activated by a customer or a clerk and which has the form, for example, of a keyboard having keys for banknotes of different values and for the number of banknotes required.

BACKGROUND ART

An apparatus of the aforedescribed kind is described and illustrated, for example, in U.S. Pat. No. 4,066,253. The apparatus includes cassettes for banknotes of 5, 10, 50 and 100 Swedish Crown denominations, and sensing means for counting banknotes and detecting the eventuality of two banknotes being dispensed at the same time. A customer is able to identify himself by means of his credit card and, having done so, is able to order a number of banknotes from the apparatus through the keyboard. The items ordered and received are assumed to be posted internally, via data processing devices. The customer does not, however, immediately receive a receipt for the withdrawal made. Other kinds of dispensing apparatus are known wherewith a receipt is issued together with the money dispensed.

However, high demands are placed on the speed and reliability in operation of the outfeed devices of this latter type of dispensing apparatus, i.e. the facility whereby a receipt is also issued may not act detrimentally on the speed and reliability of the apparatus, and therewith lower the trust which the general public has in this kind of service. The object of the present invention is to provide a dispensing apparatus which, in addition to dispensing banknotes, checks etc., is also able to dispense receipts, vouchers or the like in a manner such that the time taken to complete a dispensing operation is lengthened only slightly, or not at all, while it is ensured that a receipt is not issued when, for example, two banknotes are dispensed simultaneously.

DISCLOSURE OF INVENTION

A dispensing apparatus according to the invention comprises a further cassette provided with a separate feed device and a printing means. The further cassette is intended for checks, receipts or the like. The separate feed device is incorporated in series in the aforementioned feed means, and is arranged to advance a check, receipt or like document into a printing position adjacent the printing means and, upon completion of the printing operation, to advance the check, receipt or like document for dispatch to the outfeed opening. In certain cases, printing can be prepared before the customer makes his order, and subsequent to the order being made printing is continued at the same time as the banknotes are being dispensed, resulting in the least possible time extension for carrying out the order made by the customer (the clerk).

These and other characterizing features of an apparatus according to the invention are disclosed in the accompanying claims.

BRIEF DESCRIPTION OF DRAWINGS

The invention will now be described with reference to the accompanying drawings in which:

FIG. 4 illustrates the manner in which a receipt or traveller's check is dispensed from said further cassette, and FIG. 5 schematically illustrates the printing head and its drive means.

BEST MODE OF CARRYING OUT THE INVENTION

Figure 1:
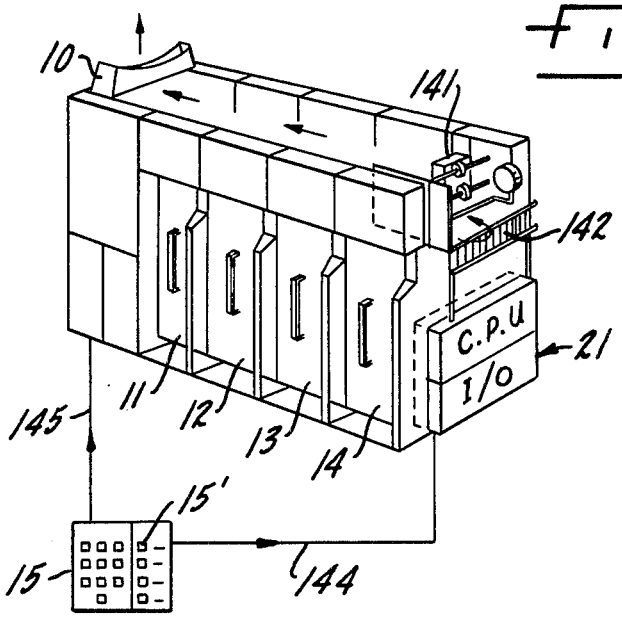
FIG. 1 illustrates schematically a plurality of cassettes for banknotes and a further cassette for receipts.

The apparatus according to FIG. 1 includes a plurality of cassettes 11, 12, 13 for banknotes, checks or other valuable documents, said cassettes being inserted in a common frame. Each cassette cooperates with a respective, separate feed device, said separate feed devices being incorporated in series in a feed means from the cassette 13 located farthest away from an outfeed opening 10 which is common to all cassettes 11–13. For the purpose of initiating dispensation of valuable documents and other documents, there is provided a dispensing initiating means or keyboard 15 which can be activated by a customer or clerk. The series connected feed devices are fully described in U.S. Pat. No. 4,066,253 and cassettes of the type suitable for use are disclosed in U.S. Pat. No. 4,283,097. The apparatus also comprises a further cassette 14 having a separate feed device 142 of the same type as the cassettes 11, 12, 13 and a printing means 141. This further cassette 14 is intended for documents such as receipts, traveller's checks or the like and is located behind the cassettes 11–13. The separate feed device 142 is arranged to advance a receipt, a check or the like to a printing position adjacent the printing means 141 and, when printing has been completed, to advance the receipt, check or the like to the separate feed device of the nearest cassette 13, for dispatch to the outfeed opening 10. When the initiating means or keyboard 15 has been activated by a customer or a clerk, the printing means 141 is arranged to print on the advanced receipt, check or the like data which depends on the order given by the customer or clerk (possibly solely data concerning the balance of the account, as will be explained in more detail hereinafter).

If the apparatus is intended for dispensing banknotes immediately after an order has been carried into effect, a receipt is advanced to a printing position and certain data printed thereon, e.g. the name of the banking establishment, the date or like information. When the next customer orders a specific number of banknotes of given denominations through the keyboard 15, printing of the receipt is commenced simultaneously as the banknotes are fed out of their respective cassettes. When the ordered number of banknotes from any or all of the cassettes 11, 12, 13 have been fed to a collecting chamber located near the outfeed opening 10 and intended for all kinds of banknotes as disclosed in U.S. Pat. No. 4,066,253, the receipt is thus already provided with the pertinent text and information concerning the withdrawal and is fed immediately, via the separate feed devices, to the collecting chamber and from there, together with the dispensed banknotes, to the outfeed opening 10, where the customer has access to a neat bundle of banknotes and his receipt.

Figure 2:
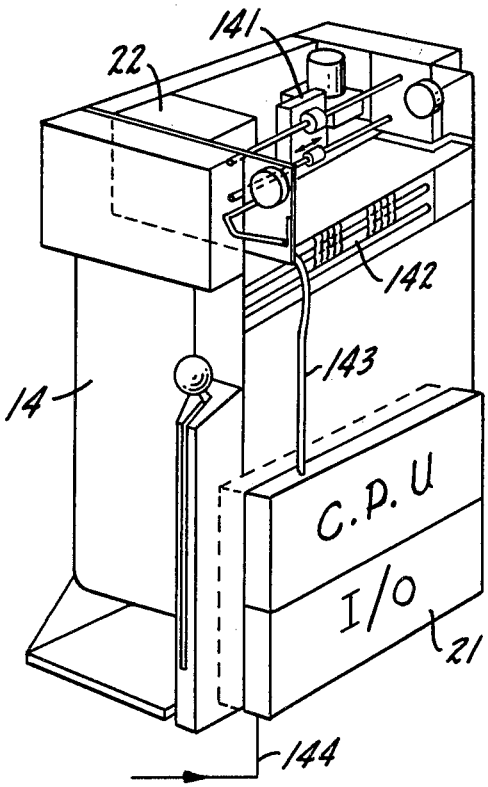
FIG. 2 illustrates said further cassette with certain associated elements, in slightly larger scale and in perspective.

FIG. 2 illustrates schematically the further cassette 14 together with printing means 141, separate feed device 142 and an electronic unit 21 for controlling the separate feed device 142 and printing means 141, and a drive unit 22 for mechanically driving the printing means.

In the illustrated apparatus of FIG. 1 the further cassette 14 is located farthest away from the outfeed opening 10. Even though such positioning of the further cassette 14 affords certain advantages it will be understood that it is not absolutely necessary and that said further cassette 14 can be placed at the top of the row or optionally between two banknote-containing cassettes for example between 12 and 13. When the further cassette 14 occupies one of the positions mentioned above, the separate feed device 142 must be formed so that it is able to feed a receipt or like document to a printing position and to feed other documents, such as banknotes, checks etc. dispatched from other cassettes to the next cassette.

Figure 3:
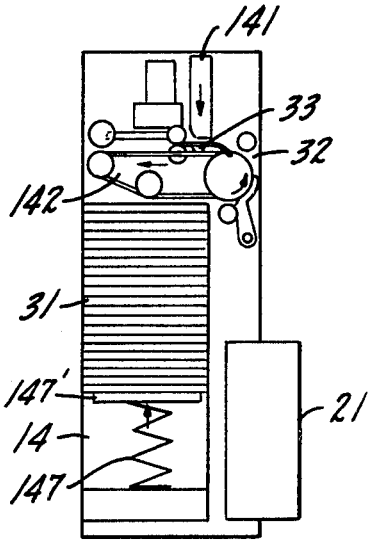
FIG. 3 is a side view of said further cassette, with its feed means.

FIG. 3 illustrates very schematically the further cassette 14 with its separate feed device 142 and printing means 141, the electronic unit 21 and a chamber 31 for receipts and an opening 32 for valuable documents fed from adjacent cassettes.

The opening 32 is also used for the receipts 31. The reference 33 identifies a printing pad for the printing means 141. With the cassette 14 having the form illustrated in FIG. 3, it is conceivable that a cassette located to the right of the cassette 14 contains either receipt blanks or forms which can be used to answer questions raised by a customer concerning latest withdrawals, the balance of his account etc. Thus, in this latter case a form is first fed out of the cassette in question and advanced to the further cassette 14 in a position for printing, whereafter control data is fed out electronically from a main data processor C.P.U. incorporated in the unit 21 which is common to a plurality of outfeed devices and to the printing means 141 which prints the information requested by the customer, whereafter the printed form is transported to the outfeed opening 10. The said cassette to the right of the further cassette 14 can be used to store check forms which, upon request from a customer or a clerk, are fed one at a time to a printing position in the further cassette 14 and there provided with data which is individual to the customer in question. These printed check forms are first collected in the collecting chamber disclosed in U.S. Pat. No. 4,066,253 and then dispensed in bundled form to the outfeed opening 10 as disclosed in U.S. Pat. Nos. 4,066,253 and 4,343,582.

If two banknotes are dispensed from a cassette at the same time, those banknotes which have already been dispensed from cassettes and advanced to the said collecting chamber (not shown) close to the outfeed opening 10 are fed to a special return chamber as described in U.S. Pat. No. 4,066,253 and a further batch of banknotes are dispensed in accordance with the order and fed to the outfeed opening 10 together with the printed receipt.

When provided with a further cassette 14 of the aforedescribed kind, provided with a printing means 141, an apparatus according to the invention can be modified in many ways for purposes other than those described without departing from the scope of the invention. These modifications are suitably effected by programming the electronic unit 21 which controls the interactions between the initiator means (the keyboard), separate feed devices, the unit for driving the printing means, and counting means and double-feed control means. Counting and double-feed control means are not disclosed here, but for details reference is made to U.S. Pat. No. 4,252,251.

For example, a customer shall be able to order a number of traveller's checks for a given sum. The checks are then dispensed one at a time from a separate cassette, are stopped in the said further cassette 14 for printing, provided with serial numbers and the sums of money concerned, and are then fed, via the separate feed devices of cassettes 11, 12, 13 located in front of said further cassette 14, to the collecting chamber, from where all the checks are dispensed in bundle form, together with associated receipt, to the outfeed opening 10. This facility can be broadened to enable a customer through one and the same order to obtain both banknotes and checks together with a receipt for the withdrawal through a plurality of interconnected operational steps. A customer may also desire to receive an extract of, for example, the withdrawals made on his check account over a quarterly period; such a request may require a plurality of forms, which are dispensed in bundle form to the outfeed opening, subsequent to being printed in the said further cassette.

The manner in which a receipt form or a traveller's check is dispensed from the further cassette 14 is illustrated in more detail in FIG. 4.

The separate feed device 142 of the FIG. 4 embodiment comprises an endless belt 40 which is held tensioned by means of a plurality of rollers or wheels 42, 42', 42'', 42''' for example. As shown in the figure, arranged in the lower part of the feed device is a wheel 41 provided with a peripheral lug 41', while arranged in the upper part of said feed device is a wheel 42 so positioned that the belt reaches its maximum height at this location. The wheel 41 is in constant frictional engagement with the belt 40 and will be rotated by the belt around its wheel shaft 41''.

When a receipt is to be dispensed, the wheel 41 and the belt 40 are driven counterclockwise by a motor 152 which receives drive signals from the C.P.U. via conductors 152' and an arm 49 is moved to an upper position 49', shown in phantom lines by an electromagnet 149, so that the belt lies against the uppermost receipt form in the space or chamber 31, said chamber containing a large number of forms. The electromagnet 149 has its movable armature connected to an arm 150 forming an extension of the arm 49. The latter arm 49 which is swingable around a pivot shaft 146 is urged downwardly by a tension spring 148 to the position shown in full lines thereby keeping the uppermost receipt out of contact with belt 40. When the arm 49 is positioned as shown in phantom lines the bundle or stock of forms in chamber 31 will be raised by a platform 147' and a spring 147 to move the uppermost form in contact with belt 40. The electromagnet 149 receives activating signals from the C.P.U. via the cable 143 and pulls the arm 150 upwardly against the force of spring 148 thus positioning arm 49 in the position 49'. When the lug 41' reaches the vertical position illustrated in FIG. 4, the belt 40 is urged with an additional pressure against the receipt forms. The dispensed form is passed by a rail 43 to the upper part of the feed device, and slides forward on a cradle 44 pivotally mounted on a horizontal shaft 48. The cradle 44 has a central opening 44'' through which the receipt is transferred when the cradle is in its lower position. The form is then advanced through the cradle opening 44'' by the belt 40, which is relatively narrow compared with the width of the form, until said form engages a guide edge 45. The guide edge 45 is arranged so that a form will be adjusted by the belt to a correct position with respect to the subsequent printing operation. When the form has been positively moved to its correct position, the cradle 44 is lifted by an electromagnet 151 together with a wheel or roller 46 which lies against the undersurface of the form. The electromagnet is activated by signals from the C.P.U. via conductors in cable 143 and swings when activated the cradle 44 clockwise to the upper position shown in FIG. 4. In its raised position the cradle takes the position 44' and the wheel 46 the position 46', and the form lies clamped between said wheel 46 and an upper feed wheel 47, the latter being driven by a motor 161 in accordance with drive signals from the C.P.U. received via conductors 161'. The form is moved out of contact with the guide edge 45. The form is then advanced by means of wheels 46, 47 to a printing position and will, in this way, be located very accurately in a predetermined printing position beneath the printing means 141, thereby ensuring good quality, straight-line printing. Immediately after the receipt form has left the chamber 31, the arm 49 is returned by spring 148 to the position shown in full lines in FIG. 4 by deactivating the magnet 149 and no further forms are dispensed despite the fact that the belt 40 and the wheel 41 are still moving.

FIG. 5 discloses the essential details incorporated in the drive unit 22 together with the printing head 141. The printing head 141 in the embodiment shown is of well-known type and arranged to print according to a 5×7 matrix. The head is provided with a corresponding number of vertically movable printing bars or printing needles each operated by an electromagnet. FIG. 4 discloses one electromagnet 162 for a printing bar 163 and each of the electromagnets receives activating signals, causing the needle to be pressed in a very short stroke against the receipt, thereby making a dot on the paper. The dots arranged in a 5×7 matrix forming letters, the letter "L" for example shown on the receipt 158 of FIG. 5. The printing head 141 is secured to an endless belt 156 cooperating with a driven roller 155 and an idle roller 150, rotating on a shaft 157 secured to the apparatus. Roller 155 is connected to the shaft of a reversible step motor which receives step signals from the C.P.U. via conductors 159 and 160, which are incorporated in cable 143. The receipt 158 is fed one line 153 at a time in the direction of arrow A by the wheel 47, the drive motor 161 of which receives line feeding signals from the C.P.U. The step motor 154 receives its step signals from the C.P.U. and in each step the C.P.U. sends the appropriate letter or symbol signals to the printing magnets of the printing head 141 in accordance with orders transmitted from the keyboard 15. When a printing line 153 has been completed the motor 154 is reversed by a reversing signal from the C.P.U. and returned to the starting point for the next line and simultaneously the receipt 158 is fed a step forwardly.

The electronic unit 21 comprises an Input/Output unit I/O. This unit I/O consists, in the example shown, of a parallel input-output unit designated ZILOG PIO, manufactured by ZILOC Incorporated of Cupertino, Calif. The I/O is in turn connected to a microprocessor or C.P.U. designated ZILOG Z 80 and manufactured by said U.S. company. The C.P.U. forms a data-AND-address bus. The parallel I/O is arranged to receive signals from external circuits and to transmit output signals in accordance with the signals received and in accordance with the programmed C.P.U. The C.P.U. is responsible for the aforedescribed working cycle.

When the amount has been keyed in on the keyboard 15 and an order issued that a receipt is to be printed by pressing a special receipt order key 15' an amount defining signal is sent from the keyboard 15 via line 145 ordering the feeding of banknotes corresponding to the amount keyed in, as is described for example in our U.S. Pat. No. 4,252,251. The amount signal is also sent via line 144 to the I/O unit and activates together with receipt printing signal C.P.U. The first signal issued by the preprogrammed C.P.U. is a start signal via line 152' to the drive motor 152, which starts the belt 40. The wheel 41 starts rotating and the belt 40 is free from the uppermost form in the chamber 31 of the said further cassette 14, because of the downward pressure exerted by arm 49 which is kept in its lowermost position by the spring 148. A signal is thereafter sent from the C.P.U. to the electromagnet 149 which raises the arm 49 to the position 49'. As already mentioned the forms in chamber 31 are lifted by platform 147' and a form is fed from the chamber 31 into abutment with the guide edge 45. When sufficient time has passed for the belt 40 to have been able to adjust the form should said form have been somewhat askew, a pulse is sent to the cradle magnet 151 which causes the form to be lifted while the wheel motor 161 receives drive signals via line 161' from the C.P.U. The first of these signals transfers the receipt 158 (FIG. 5) to printing position and the following signals to the motor 161 move the receipt from a line 153 already printed to a following line to be printed. As soon as the printing cycle has been completed the receipt is moved by wheel 47 in accordance with a signal from the preprogrammed C.P.U. into engagement with the feed device of cassette 13 and transferred via the feeding devices of cassettes 12 and 11 together with the banknotes to the opening 10. To prevent a second receipt to be caught the magnet 151 is de-activated shortly after the activating signal, thereby lowering arm 49. The drive motor 152 may be common to all the separate feeders as described in U.S. Pat. No. 4,066,253. When the printing cycle has been completed the C.P.U. interrupts the drive signal train to the motor 161 and the electromagnet 151 is deactivated.

In accordance with a modified feed device the pulses sent to the arm magnet 149, the cradle magnet 151 and the wheel motor 161 may be made dependent on sensors arranged to sense the position of the form. For the purpose of stabilizing the position of the form on the cradle 44, there can be arranged a pair of elongated fingers which are pivotable or rotatable about a horizontal shaft and which lie against the upper side of the receipt form close to the wheels 46, 47 under their own weight. In a further modification, there may be arranged adjacent the guide edge 45 two photocells whose purpose is to sense that a receipt form has been dispensed and to transmit counting pulses, and to sense the position of the receipt form adjacent the guide edge 45 and, when said receipt form is correctly positioned to send a start pulse to the cradle magnet 151 and then also to the feed wheel motor 161.

In order to ensure, when dispensing a single receipt form or a plurality of forms one after the other, that the dispensing operation takes place in accordance with the desired program without collision between two or more forms, the device may be arranged so that when a form leaves the store 31 and is acted upon by a counting finger a pulse is sent to cause stop fingers to be lowered onto the bundle of forms close to the outfeed opening 10 and together with a "counter-rotating" wheel positively preventing the form now lying uppermost in the bundle to be dispensed in an uncontrolled fashion, while sending a pulse to the electromagnet 149 operating arm 49 which causes said arm to move to the position shown in full lines in FIG. 4. If more than one form is to be dispensed, the arm 49 is caused to move to its upper position shown in phantom lines when the first form has left the printing position, and the process continues in the aforedescribed manner.

I claim:

1. An apparatus for dispensing valuable papers and other documents, such as banknotes, checks, receipts, vouchers etc., from a plurality of cassettes (11–13) to an outfeed opening (10), whereat there are arranged for the cassettes (11–13) separate feed devices, one for each cassette, which separate feed devices are incorporated in series in a feed means from the cassette (13) located farthest away from the outfeed opening to the outfeed opening (10), common for all cassettes, and whereat for initiating the outfeed of valuable papers and other documents there is provided an initiating means (15) which can be actuated by a customer or a clerk, characterized by a further cassette (14) provided with a separate feed device (142) and a printing means (141), which further cassette (14) is intended for checks, receipts or like documents and the separate feed device (142) of which further cassette is incorporated in series in the said feed means and is arranged to advance a check, receipt or like document to a printing position adjacent the printing means (141) and, subsequent to printing said check, receipt or like document, to feed said check, receipt or like document to the outfeed opening (10), and in which the printing means (141) is arranged upon actuation of the initiator means (15) by a customer or clerk to print on the advanced check, receipt or like document in accordance with the dispensation of valuable paper and other documents ordered by the customer or clerk.

2. An apparatus according to claim 1, characterized in that the further cassette (14) is located behind the cassette (13) located farthest from the outfeed opening.

3. An apparatus according to claim 1, characterized in that the separate feed device (142) of the further cassette (14) has an input opening (32) arranged to allow to pass therethrough paper from both the further cassette (14) and also from another cassette.

4. An apparatus according to claim 1, characterized in that the separate feed device (142) is arranged to firstly advance a check, receipt or like document to an adjusting position and, subsequent to making any necessary adjustment to correctly position said check, receipt or like document, to feed said check, receipt or like document to the printing position adjacent the printing means (141).

5. An apparatus according to claim 4, characterized in that the separate feed device (142) includes a guide edge means (45) which defines the adjusting position; an endless feed belt (40), which is narrow compared with the width of the check, receipt or like document; and a movably arranged cradle (44) arranged to take one position during adjustment to the position of said check, receipt or like document, and another position during the advance of said check, receipt or like document from the adjusting position to the printing position.

6. An apparatus according to claim 5, characterized in that the belt (40) is held tensioned between a plurality of wheels so that vertically it exhibits a marked maximum position (at 42) on the upper, substantially horizontal part of the feed device close to the guide edge (45); approximately at a distance from the guide edge equal to half the length of the check, receipt or like document.

* * * * *